US006016092A

United States Patent [19]

Qiu et al.

[11] Patent Number: 6,016,092

[45] Date of Patent: Jan. 18, 2000

[54] MINIATURE ELECTROMAGNETIC MICROWAVE SWITCHES AND SWITCH ARRAYS

[76] Inventors: Cindy Xing Qiu, 6215 Bienville St., Brossard, Quebec, Canada, J4Z 1W2; Yi-Chi Shih, 2216 Thorley Pl., Palos Verdes Estate, Calif. 90274; Lap Sum Yip, 57 Granville Blvd., Hampstead, Quebec, Canada, H3X 3B7

[21] Appl. No.: 09/131,594

[22] Filed: Aug. 10, 1998

[30] Foreign Application Priority Data

Aug. 22, 1997 [CA] Canada ..... 2211830

[51] Int. Cl.[7] ..... H01P 1/10

[52] U.S. Cl. ..... 333/262; 333/101; 333/105; 335/4

[58] Field of Search ..... 333/101, 102, 333/105, 262; 335/4, 5, 78; 327/510; 257/421; 200/181

[56] References Cited

U.S. PATENT DOCUMENTS

| | | | |
|---|---|---|---|
| 5,258,591 | 11/1993 | Buck | 333/262 X |
| 5,578,976 | 11/1996 | Yao | 200/181 X |
| 5,605,614 | 2/1997 | Bornand | 205/50 |
| 5,889,452 | 3/1999 | Vuilleumier | 257/421 X |

OTHER PUBLICATIONS

Larson et al, *Microactuators for GaAs–Based Microwave Integrated Circuits,* IEEE Transducers '91 Conference on Solid State Sensors and Actuators, 1991.

*Primary Examiner*—Paul Gensler

[57] ABSTRACT

Methods for the fabrication of miniature electromagnetic microwave switches are disclosed in this invention. In one embodiment, on a dielectric substrate, miniature electromagnetic switches for coplanar waveguide transmission lines are fabricated. In another embodiment, miniature electromagnetic microwave switches are fabricated for microstrip transmission lines. The miniature microwave switches are built on a dielectric substrate and are accompanied by miniature electromagnetic coils on the back of the substrate. The switch is controlled by regulating the dc current applied to the electromagnetic coil. A switch is ON when a dc controlling current is applied to the electromagnetic coil and is OFF when the controlling current is cut off. A reverse dc current may also be applied to the electromagnetic coil to repel the top electrode from the bottom electrode. The use of reverse current will prevent the possible sticking of the two electrodes, thus, reducing the switching time. For the switch described in the second embodiment, the miniature electromagnetic coils are separated from the signal lines by a grounding metal layer fabricated at the back of the substrate. In yet another embodiment, switches with two planar electrodes separated by a gap and a third element, a cantilever, are built on a dielectric substrate. Under the influence of a magnetic force, the cantilever will move downwards so that the two separated electrodes are connected.

26 Claims, 13 Drawing Sheets

(a)

(b)

(a)

(b)

(a)

(b)

(c)

(d)

(e)

(a)

(b)

(a)

(b)

(a)

(b)

(a)

(b)

(a)

(b)

(a)

(b)

(c)

(d)

MINIATURE ELECTROMAGNETIC MICROWAVE SWITCHES AND SWITCH ARRAYS

BACKGROUND OF THE INVENTION

1. Field of the Invention

The invention relates generally to miniature electromagnetic switches for microwave communication systems. More specifically, the invention relates to methods of fabricating miniature electromagnetic microwave switches and arrays of miniature electromagnetic microwave switches for coplanar waveguide, transmission lines and microstrip transmission lines.

2. Description of the Prior Art

In a modern microwave telecommunication system, a microwave switch is one of the essential parts. A switch is needed whenever a change of path for a signal or a selection of signals for a transmission line is needed. The basic requirements for such switches are low loss, high speed and small size. The last requirement is especially important for millimeter wave communication systems. The commonly used microwave switches are mostly conventional mechanical switches and semiconductor switches. The conventional mechanical switches are slow, bulky and heavy and consume a lot of power. Therefore, they are not appropriate for applications where the resource budgets (size, weight and power) are tight and for millimeter wave communication system applications even though their power handling capability is large. Furthermore, mechanical switches are discrete devices and are difficult to integrate into a switch array or matrix, which is very useful for signal routing in communication systems. One simple example of such applications is a television set with several satellite dishes. For this case, a switch array or a switch box is needed for the selection of the satellites.

Considerable efforts have been made on the development of microwave semiconductor switches. Although their power handling capability is lower than that for the bulk electromechanical switches, the semiconductor switches are fast, small and can be integrated with other components on a semiconductor substrate. These switches could be a field effect transistor (FET) or a PIN diode. The performance of the semiconductor switches are limited by the finite electrical resistance and capacitance associated with the semiconductor junctions. In the ON state of a semiconductor switch, the finite resistance at the junctions and in the semiconductor itself contribute significantly to the insertion loss. In the OFF state, the relatively large capacitance of the reversed-biased semiconductor junctions usually lead to isolation inferior to mechanical switches.

Although mechanical and semiconductor switches have performance characteristics sufficiently adequate for many applications, microwave switch designers are always on the lookout of better switches—switches with higher microwave performances, higher power, smaller size and higher switching speed. Microelectromechanical (MEM) switches offer the high isolation and smaller insertion loss similar to mechanical switches but with size not much bigger than semiconductor switches. The switching speed of MEM switches lies between mechanical and semiconductor switches. MEM switches based on electrostatic actuation have been invented and demonstrated good switching properties in recent years. These include the rotating switch disclosed in U.S. Pat. No. 5,121,089 granted to L. E. Larson. In his switches, a rotating switchblade rotates about a hub under the influence of an electrostatic field created by control pads on the same substrate. A microwave signal can then be selectively transmitted along the transmission lines. The switches demonstrate excellent impedance match and very small loss. However, the lifetime of these switches is small because of wearing of the turning parts. In U.S. Pat. No. 5,619,061 granted to C. P. Goldsmith, microwave MEM switches with both ohmic and capacitive coupling of the rf lines were described. In these switches, electrostatic force is used to pull a membrane down to connect two microstrip lines. To pull down the membrane, a voltage of several tens of volts must be applied to the controlling electrode. There is the problem of sticking and electric charges accumulation on the dielectric membrane. To overcome these problems, a novel MEM switch, which is based on electromagnetic actuation, suitable for microwave applications has been invented and will be described in this patent.

SUMMARY OF THE INVENTION

The present invention provides novel miniature switches and switch arrays for microwave communications and the methods to fabricate the same. In one embodiment, miniature electromagnetic microwave switches for coplanar waveguide (CPW) transmission lines are disclosed. To fabricate such switches, a miniature structure is created on a dielectric substrate by a micromachining process or an evaporation process and a thin film miniature electromagnetic coil is deposited on the back of the substrate. This miniature structure can be a step, a channel or a cavity with the height of the step defining the separation between the movable top electrode and the bottom electrode in the OFF position. After the deposition of the bottom electrode, a sacrificial layer is applied to fill the cavity, the channel or the lower part of the step. The top electrode is then deposited and a layer of permanent magnetic material is coated on the top surface of the top electrode. Once the sacrificial layer is removed, the top electrode is a cantilever suspended over the bottom electrode and the two electrodes are separated by the height of the step. The cantilever can be bent downwards to touch the bottom electrode or be pushed upwards under the influences of the induced magnetic forces from the electromagnetic coil, depending on the direction of the induced magnetic field. Thus, miniature electromagnetic microwave switches can be selectively switched ON and OFF by changing the directions of the dc currents applied to the electromagnetic coils. The switches can also be switched OFF by simply switching off the dc current to the electromagnetic coils. For capacitive switches, the cantilever is partly made of dielectric materials. The permanent magnetic layer can also be replaced by a layer of soft magnetic film to achieve a similar mechanical effect on the cantilever. The dimensions of the cantilever and electrodes can be designed to the specifications of the coplanar waveguide transmission lines.

In another embodiment, miniature electromagnetic microwave switches are made with the input and output electrodes fabricated on the same level but with a separation gap. A non-electrode cantilever is suspended on top of the separation gap. With the magnetic layer on the top, the cantilever will be pulled down when a magnetic force is applied. It will touch the two electrodes and connect them together.

In yet another embodiment, miniature electromagnetic microwave switches and switch arrays for microstrip transmission lines are disclosed. In this embodiment, a grounding metal layer is built into the dielectric substrate to form the structure of the microstrip and at the same time separate the electromagnetic coils and the electrodes. With a few changes to the microstrip switches, switches suitable for microwave striplines can be built.

In and yet another embodiment, a method to fabricate an enhanced miniature electromagnetic switch is disclosed. This enhanced miniature switch has a central ferromagnetic core inserted into the central opening of the microstructure to enhance the induced magnetic field.

In still another embodiment, cantilever is fabricated to be supported by a metal bubble or a metal hinge attached to the cantilever. This metal bubble or hinge is formed at the same evaporation step.

There are many advantages to these novel miniature electromagnetic switches and the processes to fabricate the same. First of all, they are very small in size and the conventional IC fabrication techniques are used to fabricate the miniature electromagnetic switches. Thus, they can easily be integrated into the integrated circuits. Secondly, the processes to fabricate a single switch and arrays of switches are the same except for the mask difference. Thus, many switches can be fabricated on a single substrate in a single fabrication run. Because the control circuits are fabricated on the same substrate, the switch array can be very compact. Furthermore, the switches also have an excellent impedance match with transmission lines and show extremely large OFF impedance and very small ON impedance. Finally, by applying a reverse current to the coils, sticking of the electrodes can be avoided and this ensures the cantilever to return to the OFF position quickly.

DETAILED DESCRIPTION OF THE PREFERRED EMBODIMENTS

Figure 1:
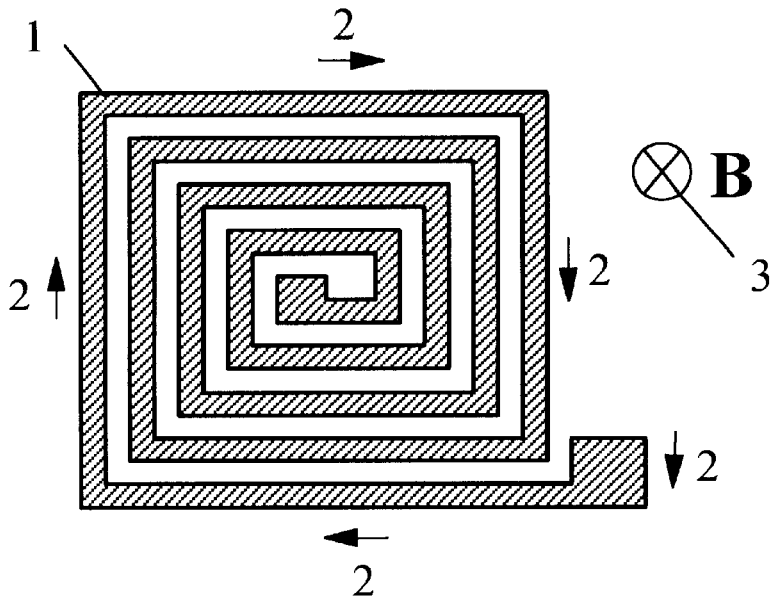
FIGS. 1(*a*) and (*b*) are schematic top-views of a thin film electromagnetic coil showing the directions of the induced magnetic field, (*a*) pointing into the paper and (*b*) pointing out of the paper. The coil in (*b*) is the same as in (*a*) but with opposite electric current direction.
Figure 1:
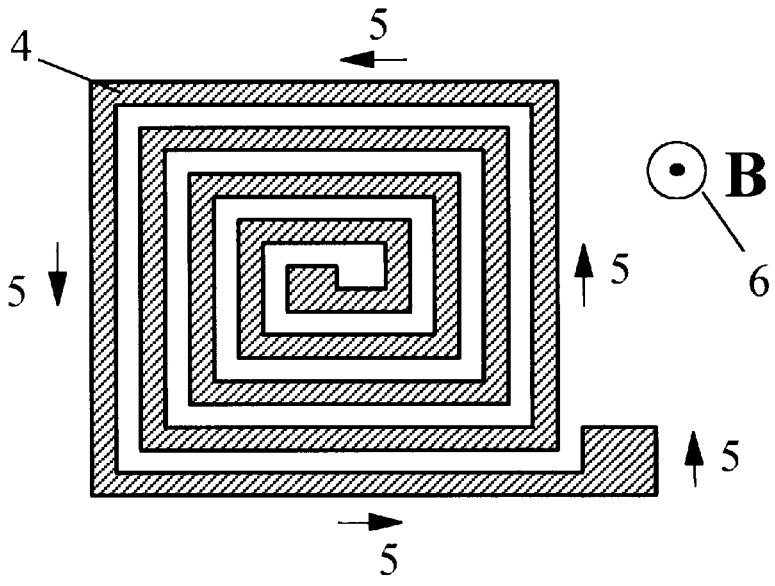

In FIG. 1(*a*), a schematic top-view of a thin film electromagnetic coil (1) is shown. When a current (2) is flowing clockwise through the coil, a magnetic field (3) is induced with the direction pointing into the paper. When the direction of the current (5) is changed to counter-clockwise through the thin film coil (4) (See FIG. 1(*b*)), the induced magnetic field (6) is pointing out of the paper. Once inside a magnetic field, a magnetic film, depending on its orientation of magnetization, will move either towards or away from the field. This characteristic of magnetic materials is used to build the switches of this invention.

Figure 2:
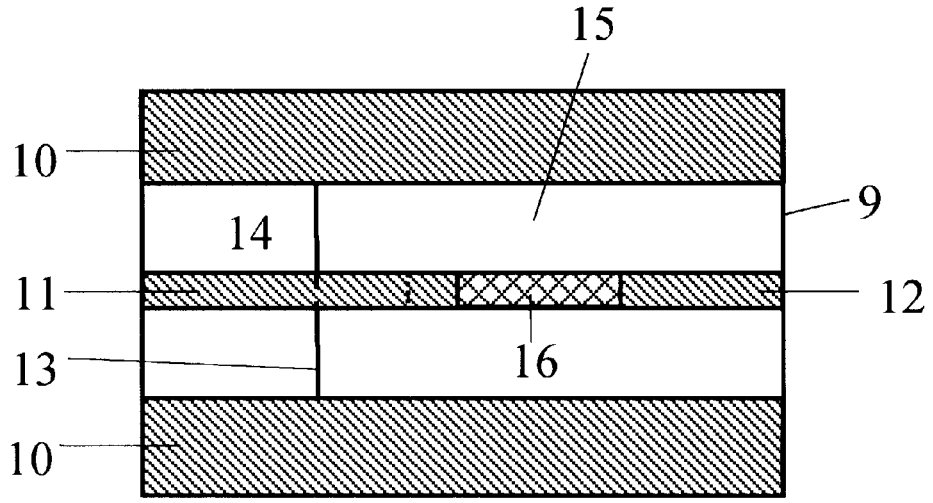
FIG. 2(*a*) is a schematic top-view of a miniature electromagnetic switch for coplanar waveguide transmission lines, (*b*) shows the cross-sectional view of the miniature switch, (*c*) the same miniature switch in the ON state is shown, (*d*) a reverse current pushing up the top electrode to the OFF position is displayed and (*e*) shows a top electrode composed of a metal layer on top of a dielectric membrane for capacitive coupling.
Figure 2:
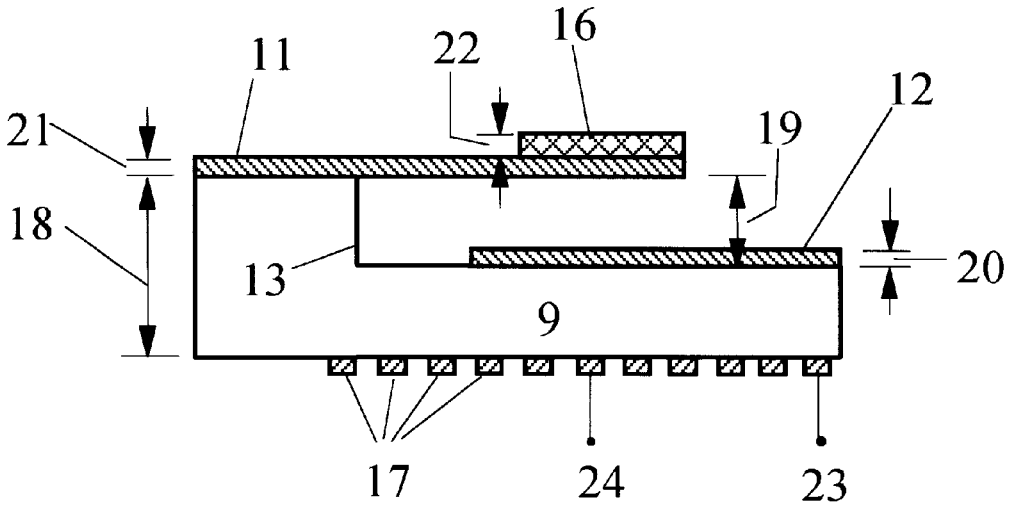
Figure 2:
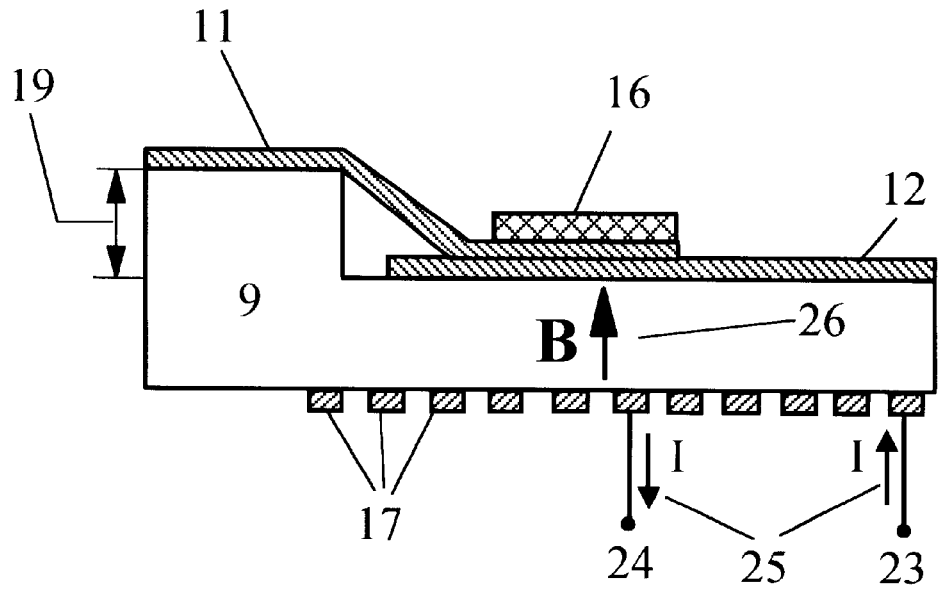
Figure 2:
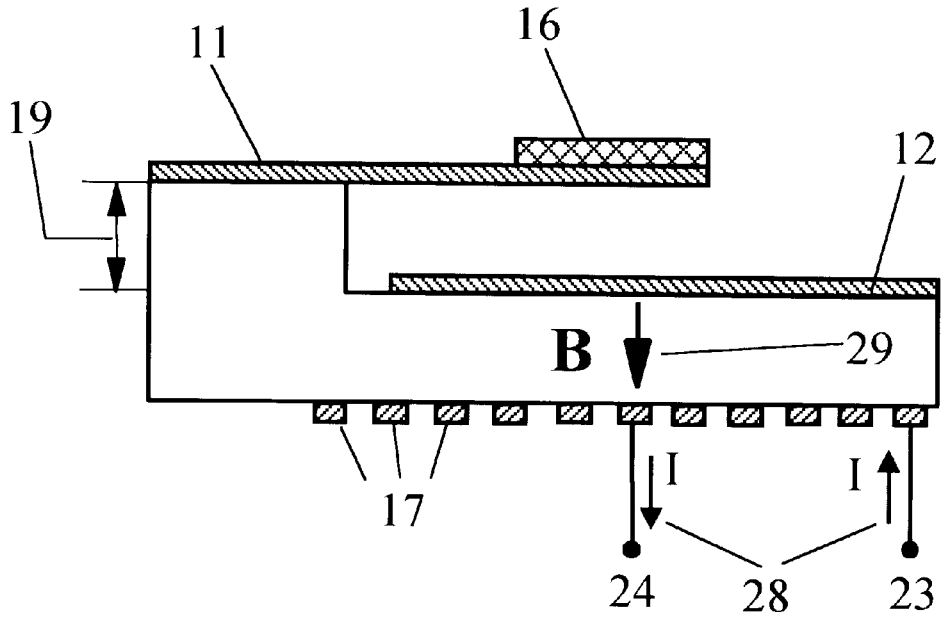
Figure 2:
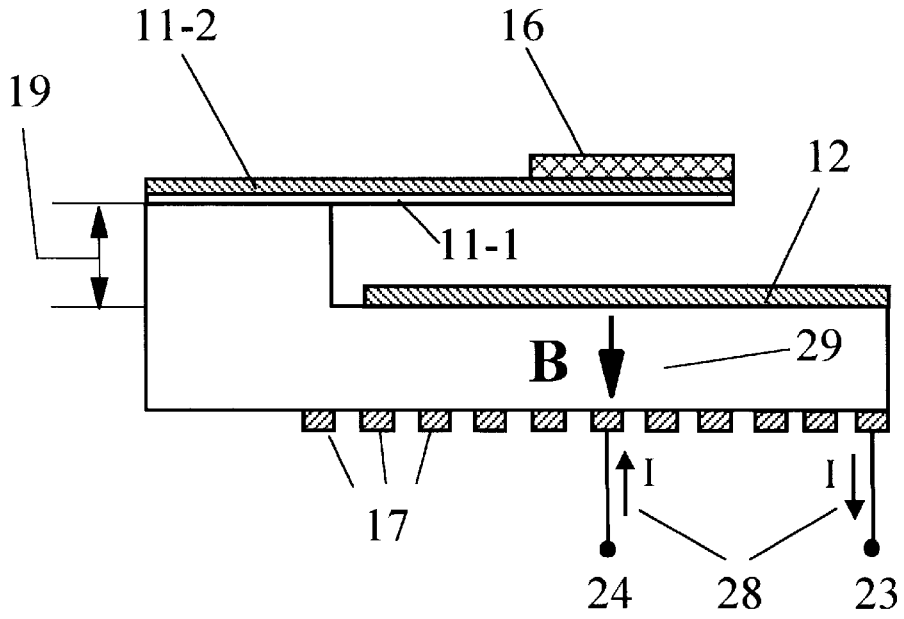

Preferred Embodiments of Miniature Electromagnetic Switch for CPW Transmission Lines 1. Switches with the Cantilever Connected to the Top Electrode (1) Resistive Coupling A schematic top-view of a miniature electromagnetic switch for coplanar waveguide transmission lines is shown in FIG. 2(*a*). The miniature electromagnetic switch is fabricated on a dielectric substrate (9) with two ground lines (10) deposited on each side of the signal electrodes (11) and (12). A micro-step (13), which divides the front surface into two regions (14 and 15), is micromachined on to the front surface of the substrate. (9), The region on the left, the top front surface (14), is elevated above the region on the right, the bottom front surface (15). The top electrode (11) is a metal membrane deposited over the step (13) with part of it supported on the higher region at the left (or the top front surface) (14) and the rest suspended over the lower region on the right (or the bottom front surface) (15) forming a cantilever. In this case, one can also say that the cantilever is electrically connected to the top electrode. The bottom electrode (or the output electrode) (12) of the signal line is made of metal film deposited on the bottom front surface (15). The top electrode (or the input electrode) (11) is aligned with the bottom electrode (12) so that a perfect contact with the bottom electrode (12) will be made when the top electrode cantilever (11) is pulled down by the induced magnetic field. The widths of the electrodes (11) and (12) are designed to achieve the best impedance match in the CPW structures. Part of the top electrode (11) is coated with a layer of magnetic film (16). Here, the top electrode (11) can be defined as the input electrode and the bottom electrode (12) as the output electrode or vice versa.

The schematic side-view of the switch is shown in FIG. 2(*b*). On the back surface of the substrate (9), a thin film electromagnetic coil (17) is deposited under the signal lines (11 and 12). The separation between the top electrode (11) and the bottom electrode (12) is defined by the height (19) of the micro-step (13). The distance between the bottom electrode (12) and the thin film coil (17) is determined by taking the distance (18) between the top electrode (11) and the coil (17) and subtracting away the height (19) of the step (13). The thicknesses (20 and 21) of the bottom electrode (12) and the top-electrode (11) are the same which may be in a range from 0.5 to 10 micron and are preferably close to the thicknesses of the CPW lines to achieve better impedance match. At the same time, the thickness (21) of the top-electrode has to be thick enough to endure the bending stress of the cantilever. The thickness (22) of the magnetic film (16) is selected to achieve easily the actuation of the top electrode cantilever (11). Contacts (23) and (24) are made for the dc electric current to flow into and out of the coil.

When a dc control current (25) in FIG. 2(*c*) is flowing into the thin film electromagnetic coil (17) through the contact on the right (23) and flowing out of the coil (17) through the contact on the left (24), the induced magnetic field (26) is pointing upwards. The schematic cross-sectional view of the switch with dc current applied to the coil is also shown in FIG. 2(*c*). When the control current (25) is greater than a pull down threshold current, the top electrode cantilever (11) is pulled down because of the strong magnetic attraction to the magnetic film (16) on the cantilever (11). The pull down threshold current is defined as the minimum control current that required to actuate (or pull down) the top electrode cantilever (11) to touch the bottom electrode (12). The downward movement of the top electrode (11) results in contact between the top electrode (11) and the bottom electrode (12), therefore, turning on the miniature switch. As shown in FIG. 2(*d*), when a dc current (28) is flowing into the coil from the left contact (24) (in a direction opposite to the current (25) in FIG. 2(*c*)), the direction of the induced magnetic field (29) is downwards. This magnetic field (29) will push up the top electrode cantilever (11) due to the repulsion with the magnetic film (16) on the top electrode (11), switching off the switch. The switch can also be switched to Off state by simply switching off the controlling dc current (25, in FIG. 2(*c*)).

One should note that the reaction between the magnetic field and the magnetic film is determined by both the direction of the magnetic field and the nature of the magnetic film. Reversed action could result if magnetic films of different properties are used. The actual directions of the controlling dc current for On and Off are determined after the magnetizing process.

A layer of dielectric film can be added between the cantilever and the magnetic film for isolation. Such an isolation may be needed to reduce possible losses of the microwave signal caused by the magnetic film.

Finally, the cantilever can also be made of a dielectric membrane on top of a metal layer. The adding of the dielectric membrane might enhance the strength of the cantilever.

(2) Capacitive Coupling

For capacitive coupling, the top electrode (11-1 and 11-2) in FIG. 2(*e*) is composed of a dielectric membrane (11-1) and a metal layer (11-2) with the dielectric membrane (11-1) on the bottom and the metal layer (11-2) on the top of the cantilever. The thickness of the dielectric membrane (11-1) and the contact area determine the capacitance value for the coupling in the On state.

(3) Switches Using Soft Magnetic Film

Instead of a permanent magnetic layer, the top electrode of the miniature electromagnetic switches can also consist of a metal membrane covered by a soft magnetic layer. In the presence of a magnetic field, the soft magnetic material will be magnetized and drawn to the bottom electrode. When the controlling current is cut off, the top electrode will return to the original Off position. One can also build a second electromagnetic coil on a dielectric substrate and place it to the top of the switch. Once the current to the first coil is cut off, a current to the second coil can actuate the cantilever to the Off position.

(4) Switches Using Movable Magnet

The thin film electromagnetic coil of the miniature switch can be replaced by a movable electromagnetic coil or a movable permanent magnet. When a movable magnet is brought close to the back of a switch, it pulls down the cantilever to the ON position and the removing of the movable magnet returns the switch to the OFF position.

2. Switches With the Cantilever as a Non-Electrode Switch Arm

Figure 3:
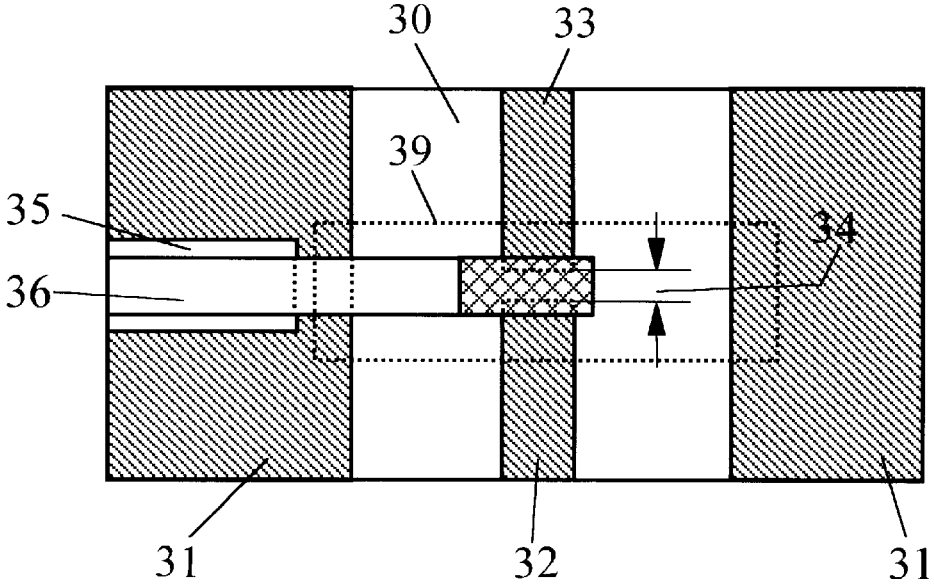
FIG. 3(*a*) is a schematic top-view of a CPW miniature electromagnetic switch with two electrodes built at the same level and a cantilever acting as the switch arm and (*b*) is the schematic side-view of the switch.
Figure 3:
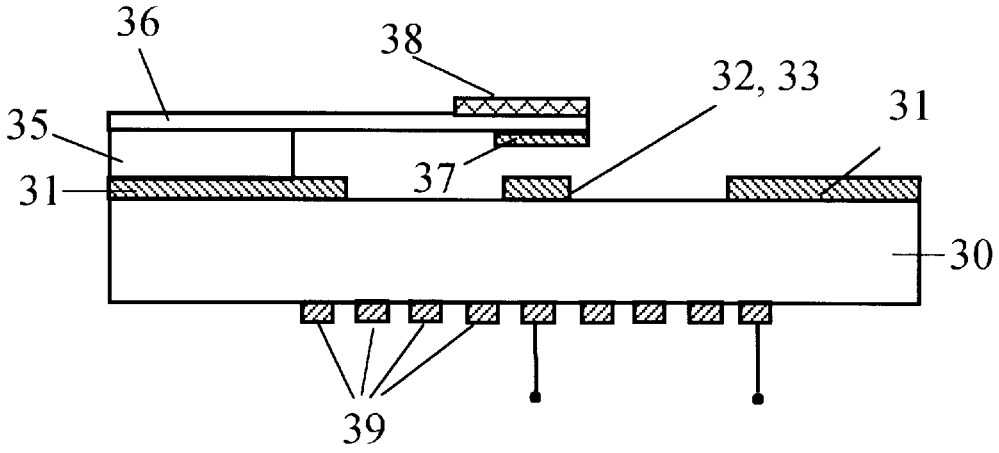

The structure of the miniature electromagnetic switch can be modified in such a way that the cantilever is no longer connected electrically to one of the two electrodes and represents purely a movable arm that can bend upwards or downwards under the influence of a magnetic field. Schematic top-view and side-view of the switch are shown in FIGS. 3(*a*) and (*b*). The miniature switch is built on a dielectric substrate (30) with two metal films (31) as the ground lines of the CPW transmission line. Two metal electrodes (32) and (33), with (32) as the input electrode and (33) as the output electrode, are deposited in the middle of the substrate (30). The input and output electrodes are interchangeable. There is a gap (34) between the input and output electrodes. A dielectric block (35) is built on one of the metal strips (31) and a dielectric cantilever (36) is deposited. The cantilever (36) is partly on top of the dielectric block (35) and partly hanging over the gap (34). The width of the gap (34) is smaller than the width of the cantilever (36). A metal film (37, in FIG. 3(*b*)) is deposited on the bottom surface of the cantilever (36). This metal film is made to connect the two electrodes (32 and 33) when the switch is in the On state. A magnetic layer (38) is finally deposited on top of the cantilever (36) and a thin film electromagnetic coil is deposited on the back surface of the dielectric substrate.

The cantilever of the miniature electromagnetic switch also can be made of a simple metal membrane covered with a layer of magnetic material (not shown) to simplify the fabrication processes. For capacitive coupling, a dielectric membrane with a conducting top layer is fabricated to form the cantilever.

Preferred Embodiments of Miniature Electromagnetic Switch for Microstrip Transmission Lines 1. Switches With the Cantilever Connected to the Top Electrode (1) I-Shape Switch In FIG. 4(*a*), a schematic top-view of a miniature electromagnetic microwave switch for microstrip transmission lines is shown. It starts with a dielectric substrate (40) with a micromachined step (41). The top electrode (42) is deposited over the step (41) and part of it forms a cantilever which can bend up or down under the influence of a force. The top electrode (42) is coated with a permanent magnetic film (43). The bottom electrode (44) is deposited on the bottom front surface of the dielectric substrate (40). The top electrode (42) is aligned with the bottom electrode (44) so that it will make perfect contact with the bottom electrode (44) when the top electrode cantilever (42) is pulled down by the induced magnetic field. The widths (45-1 and 45-2) of the electrodes (42) and (44) are designed to achieve the best impedance match for microstrip transmission lines. The top electrode (42) is also slightly wider than the bottom electrode (44) because of the distance difference between the grounding layer and the electrodes. The electromagnetic coil (46) is deposited on the back surface of the substrate right underneath the overlapping regions of the electrodes (42 and 44).

Figure 4:
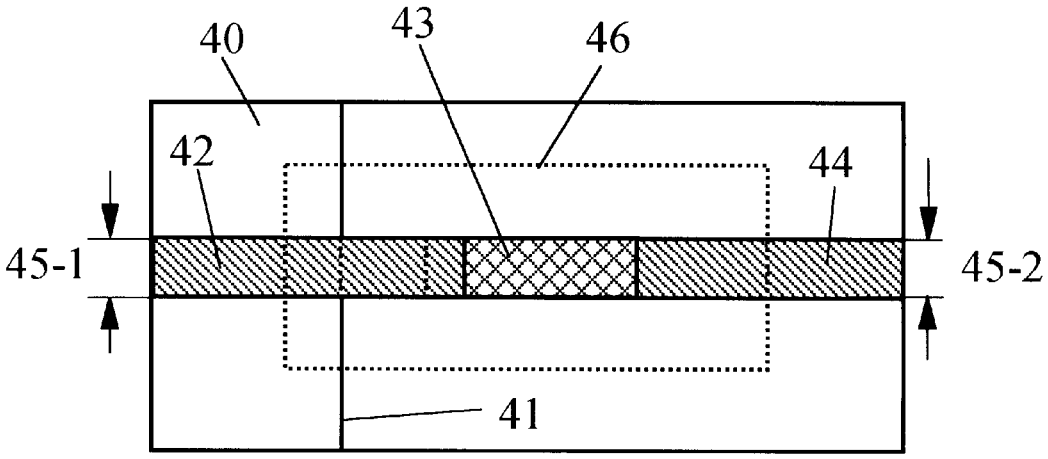
FIG. 4(*a*) is a schematic top view of a miniature electromagnetic switch for microstrip transmission lines and (*b*) is a schematic side-view of the miniature switch.
Figure 4:
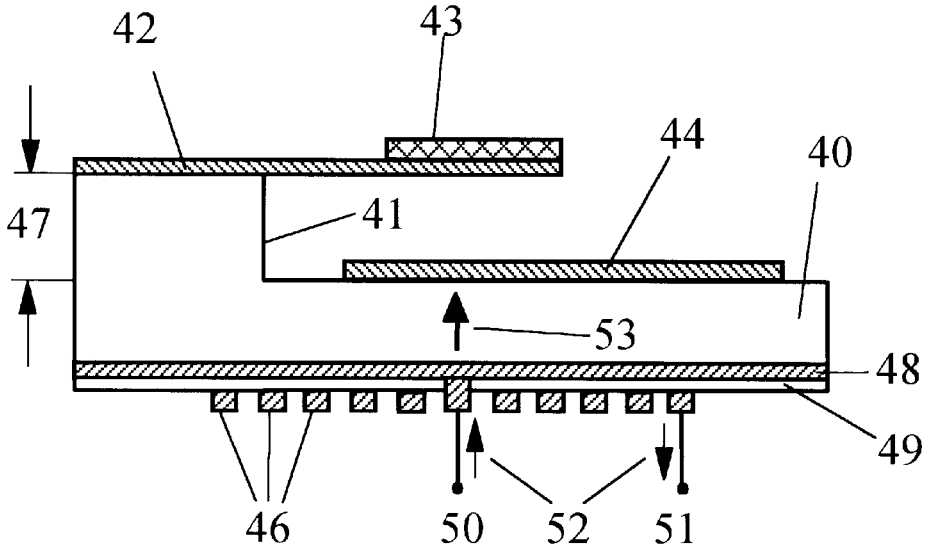

The schematic side-view of the switch is shown in FIG. 4(*b*), where the height (47) of the step (41) is determined by the open impedance required for the switch. A grounding metal layer (48) is deposited on the back surface of the dielectric substrate (40) to form the complete structure of the microstrip line. A dielectric thin film layer (49) is deposited on the grounding layer (48) and a thin film electromagnetic coil (46) is deposited directly on the dielectric thin film layer (49). The grounding layer (48) also isolates the signal line electrodes (42 and 44) from electromagnetic coil (46), thereby preventing interference between them. Contacts (50) and (51) are made so the dc control current (52) can flow into and out of the coil (46). The center contact (50) of the coil can be directly connected to the ground plate (48) to simplify the structure. When a dc current (52) greater than a pull down threshold is applied to the electromagnetic coil (46), an induced magnetic force (53) will either attract the top electrode (42) so that it touches the bottom electrode (44) or it will cause the top electrode (42) to be expelled away from the bottom electrode (44). The action depends on the orientation of the magnetization of the(2) L-shaped switch and the magnetic field (53).

(2) L-Shaped Switch

Figure 5:
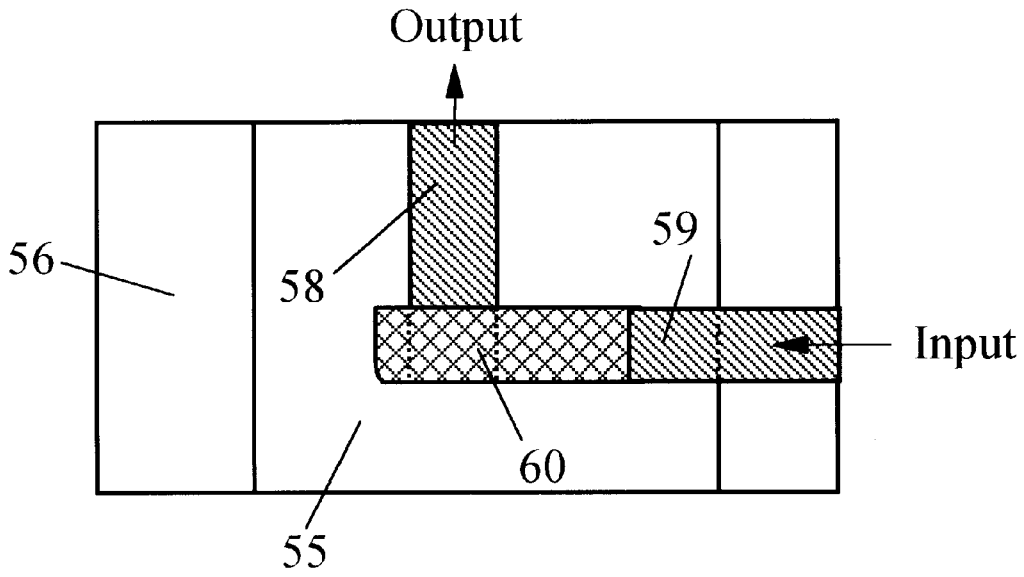
FIG. 5(*a*) is a schematic top-view of an L-shaped miniature electromagnetic switch for microstrip transmission lines and (*b*) is a side-view of the switch.
Figure 5:
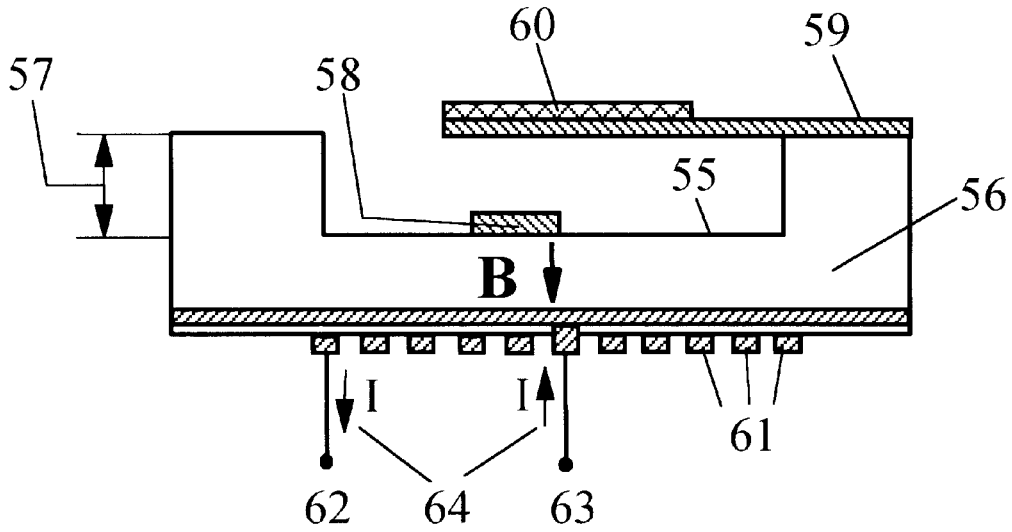

The structure of the switches can be modified from an I-shape into a L-shaped structure as shown in FIGS. 5(*a*) and 5(*b*), where the top-view of the switch in the On state is shown in 5(*a*) and the side-view of the switch in the Off state is shown in 5(*b*). In this structure, a channel (55) is etched into the middle of a dielectric substrate (56) and the height (57, Shown in FIG. 5(*b*)) of the channel (55) is determined by the required open impedance. A bottom electrode (58) is deposited on the bottom of the channel (55). The top electrode (59) is supported by one bank of the channel (55) and it (59) has a 90 degree angle with the bottom electrode (58). The top electrode (59) is also coated with a layer of permanent magnetic material (60). Electromagnetic coil (61, shown in FIG. 5(*b*)) is deposited on the back of the substrate (56) with two contacts (62) and (63) for the controlling current (64) to flow into and out of the coil (61). The center contact (63) is connected directly to the ground plate. One corner of the top and bottom electrodes (58 and 59) is preferably rounded, as shown in FIG. 5(*a*), to reduce power loss.

2. Switches With the Cantilever as a Non-Electrode Switch Arm

Figure 6:
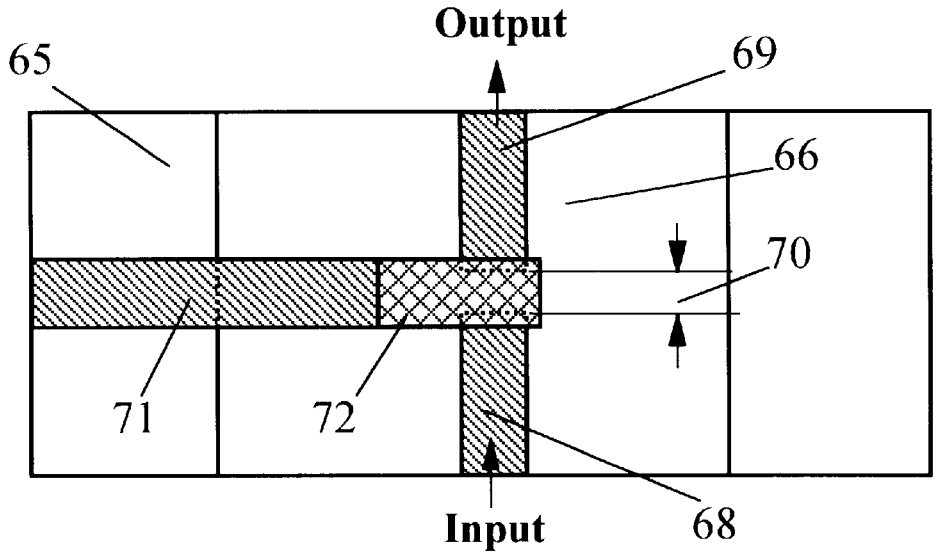
FIG. 6(*a*) is a schematic top-view of the miniature electromagnetic switch for the microstrip transmission lines with the two electrodes built on the same level and the cantilever acting as a controlling arm and (*b*) is the side-view of the switch.
Figure 6:
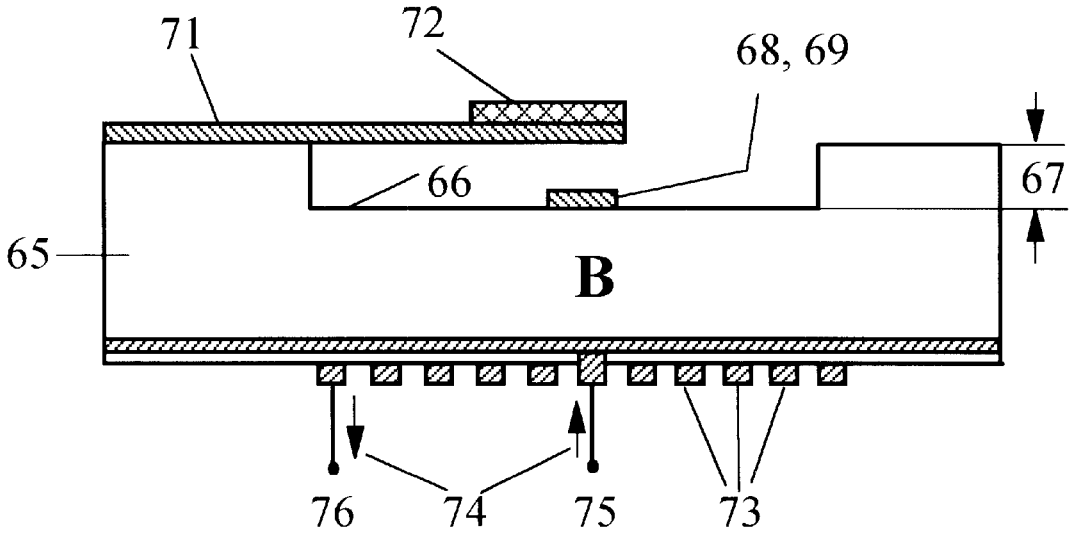

In another preferred embodiment the cantilever is not connected electrically to one of the two electrodes in the miniature switches. In this structure, the two electrodes are at the same substrate level, therefore, the widths of the input electrode and the output electrode are the same and there is a better impedance match to the transmission lines. A schematic top-view of such a switch in the Off state is given in FIG. 6(*a*) and the side-view of the switch is shown in FIG. 6(*b*). The switch is built on a dielectric substrate (65) with a channel (66) etched into the substrate (65). The height of the bank (67, in FIG. 6(*b*)) determines the separation between the conducting cantilever membrane (71) and the two electrodes. The two electrodes (68) and (69) are deposited on the bottom of the channel (66) with a gap (70) in between. This gap (70) determines the open impedance of the switch. Again, the cantilever conducting member (71) is coated with a layer of permanent magnetic film (72, FIG. 6(*b*)) on top. The conducting cantilever membrane can be replaced with a dielectric membrane with metal coating on the bottom surface. A thin film electromagnetic coil (73, in FIG. 6(*b*)) is deposited on the back of the substrate (65) with the center contact (75, in FIG. 6(*b*)) connected to the ground plate. In FIG. 6(*b*) when a controlling current (74) is flowing into and out of the contacts (75) and (76), a magnetic field is induced to switch On or Off the switch, depending on the orientation of magnetization of the magnetic film (72).

Preferred Embodiment of Miniature Switches for Striplines (1) One-Throw Switches With the addition of a few elements, the above described basic structures of microstrip miniature switches can be used to form miniature switches for striplines. These changes include: Placing a second dielectric substrate, which has the same thickness as that of the dielectric substrate of the switch, on top of the microstrip line switch; and covering the front surface of the second dielectric substrate with a conducting layer. When a dielectric layer is coated on top of the conducting layer, a thin film electromagnetic coil can also be added to the front surface of the second dielectric substrate. Since the coil on the top alone can be used for the controlling of the cantilever, thus, it can be used as a backup coil for the switch or be used together with the coil on the bottom to enhance the induced magnetic field. It can also be used to switch Off the switch.

(2) Two-Throw Switches

A single stripline switch with a two-throw function also can be fabricated with this structure. For switches with the cantilever connected to the top electrode, a step is micromachined into the back surface of the second dielectric substrate and an electrode is deposited on the etched back surface of the second dielectric substrate. The cantilever, with a structure of metal/magnet/metal or metal/dielectric/magnet/dielectric/metal can be controlled either to move downwards to touch the bottom electrode on the first dielectric substrate or to move upwards to touch the top electrode on the second dielectric substrate. For the switches with the cantilever as a non-electrode part, a second set of input and output electrodes are deposited on the etched back surface of the second dielectric substrate. The cantilever can be controlled either to move downwards to connect the two electrodes on the bottom dielectric substrate or to move upwards to connect the two electrodes on the top dielectric substrate.

Preferred Embodiments of Two-throw T/R Switch Box

1. Switch Box With Cantilever as a Non-Electrode Switch Arm

Figure 7:
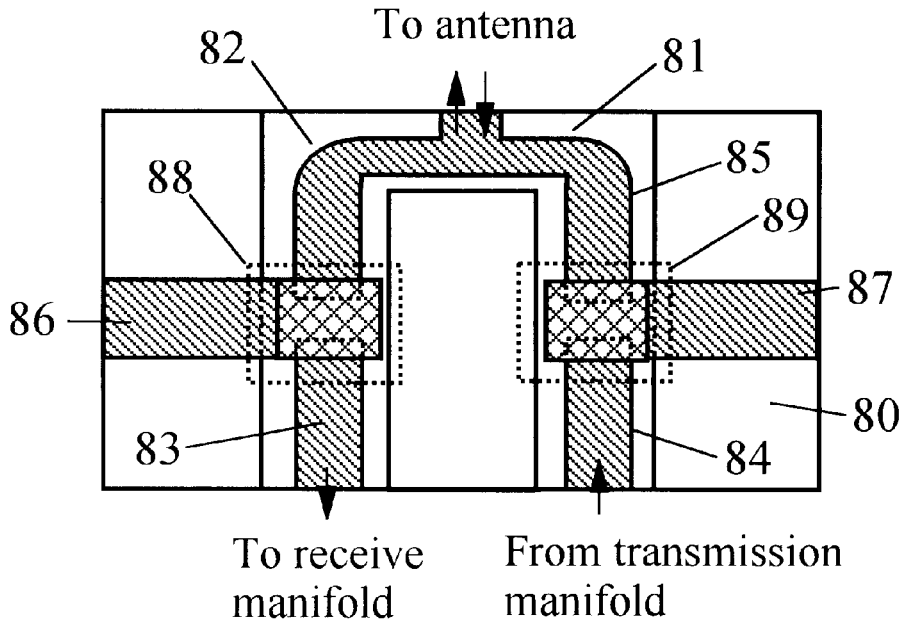
FIG. 7(*a*) is a schematic top-view of a design for a two-throw electromagnetic switch box used for the selection of T/R functions. (*b*) is another design of the two-throw switch box.
Figure 7:
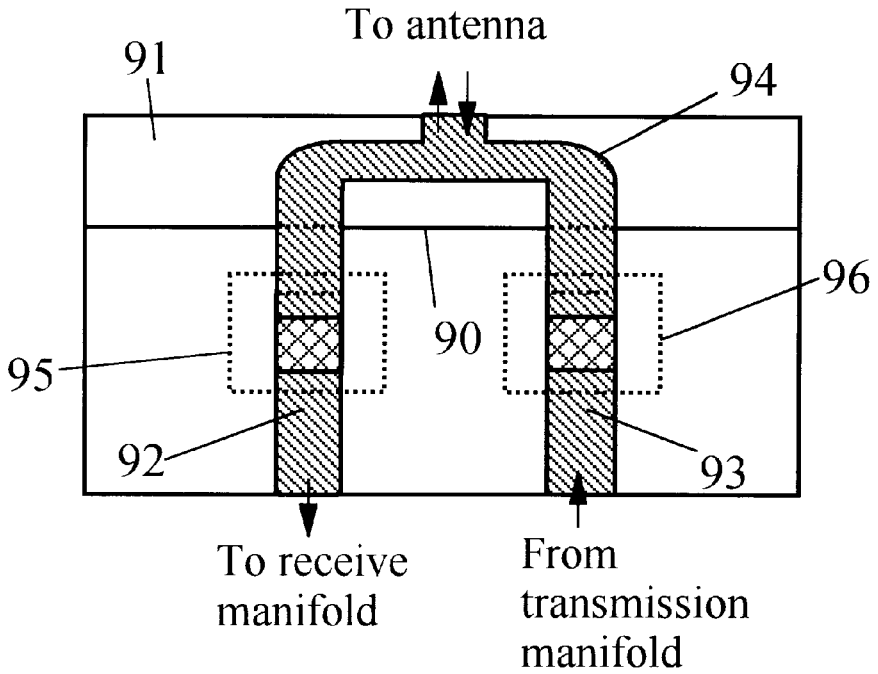

The switch box shown in FIG. 7(*a*) has two switches built on a dielectric substrate (80). Two channels, (81) and (82) are micromachined on the substrate (80) with the two channels (81 and 82) joined together on the top end. Two electrodes, (83) and (84), are deposited in each of the channels (81) and (82). The C-shaped electrode (85) is the counter electrode for both switches. The switch box uses two cantilevers, (86) and (87), as the controlling arms for the two switches. Electromagnetic coils, (88) and (89), built underneath the electrode gaps, control cantilevers (86) and (87) respectively, so the corresponding switch can be switched On or Off. The center contacts of the two coils are connected to the ground plate (not shown) on the back of the substrate (80). The currents that control the switches ensure that only one of the switches will be in the On state. Since the open impedance of the switch is very large, the receiving manifold is protected from damage during transmission.

2. Switch Box With Cantilever as the Top Electrode

The other preferred embodiment for the two-throw switch box is shown in FIG. 7(*b*). The switch is built on a step (90) etched on a dielectric substrate (91). Two electrodes (92) and (93) are deposited on the lower part of the step (90). The C-shaped electrode (94) is partly on the higher part of the step (90) and partly suspended over the electrodes (92) and (93). Thin film electromagnetic coils (95) and (96) are located on the back side of the substrate (91).

Preferred Embodiments of Multi-Throw Switch Array

1. I-Shape Switch Array

Figure 8:
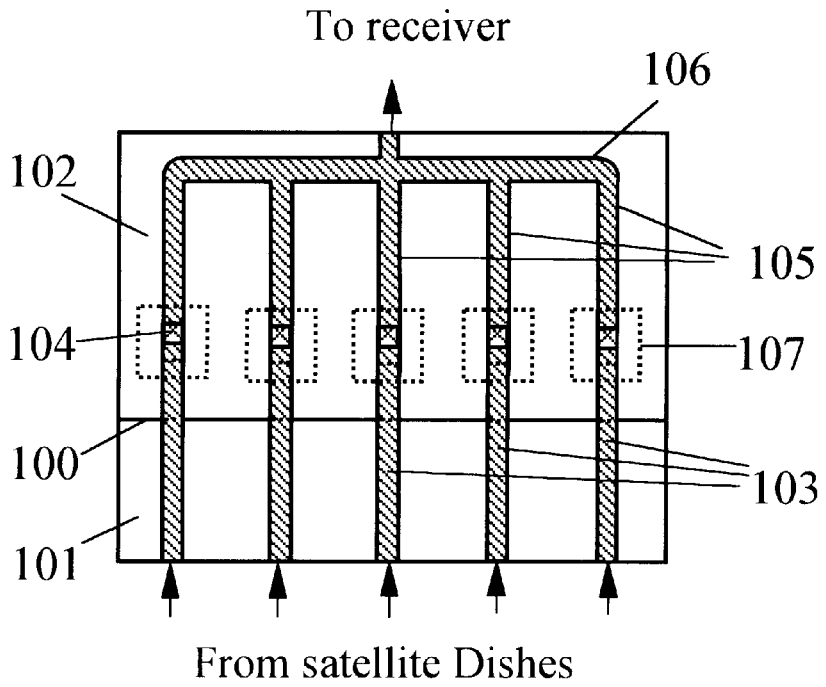
FIG. 8(*a*) is a schematic top-view of an I-shape multi-throw electromagnetic switch array for the selection of satellite dishes, (*b*) is a L-shape satellite switch array, (*c*) is a switch array with electrodes on the same level and (*d*) is a schematic drawing of a control system for the switch arrays shown in (*b*) and (*c*).
Figure 8:
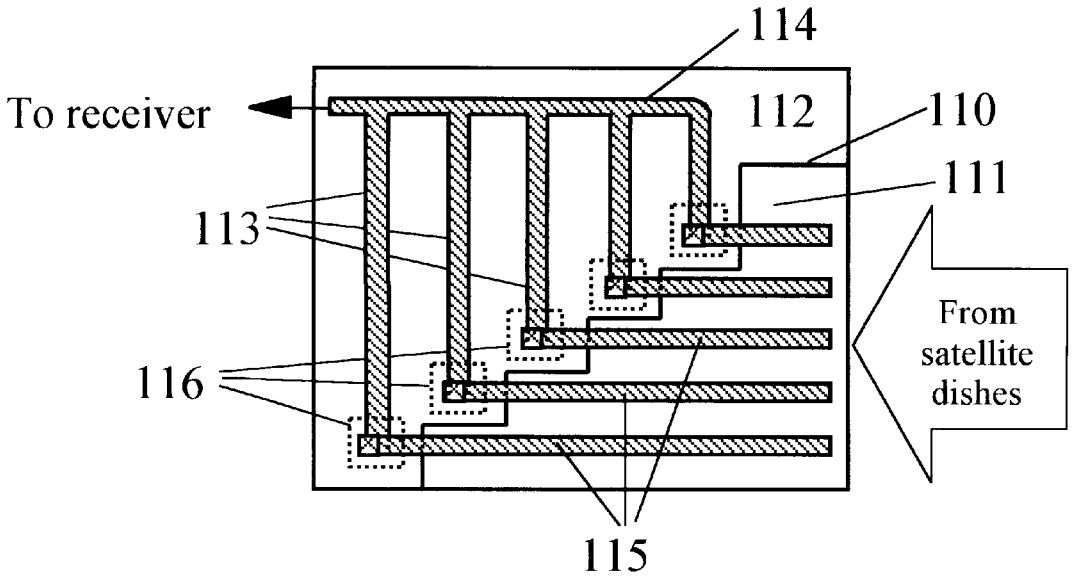
Figure 8:
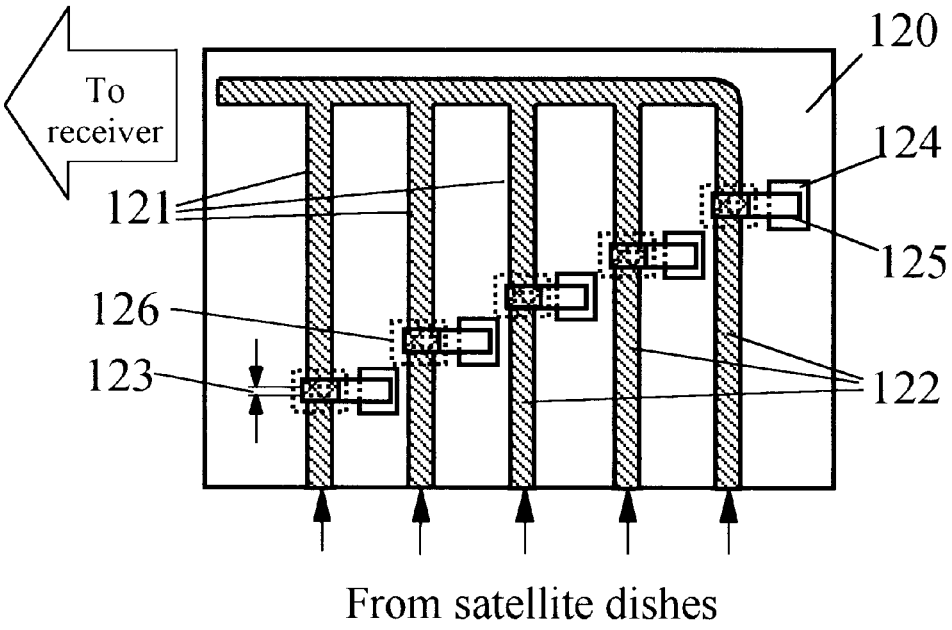
Figure 8:
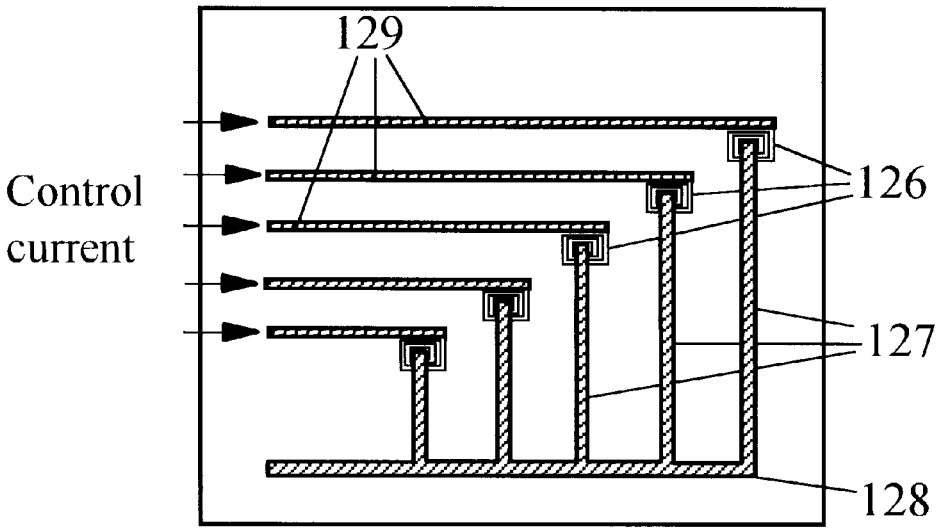

One preferred embodiment switch array for the microstrip transmission lines is shown in FIG. 8 (*a*). As an example of one of its applications, the switch array is used to select the input signal from an array of satellite dishes. The array of five switches is built on a dielectric substrate with a step (100) etched on it. The step (100) defines a top front surface region (101) and a bottom front surface region (102). Parallel top electrode cantilevers (103) are deposited on the top front surface (100) with a magnetic layer (104) on the top. Parallel bottom electrodes (105) deposited on the lower region (102) are joined together at one end by a metal strip (106). Thin film coils (107) are built on the back surface of the substrate after a metal ground layer and a layer of dielectric material (not shown) are deposited on the back surface. The center contact for all the coils is fabricated to connect with the ground metal layer. When one of the switches is switched on by sending a control current, which is greater than the pull down threshold, to the corresponding controlling coil, the top electrode (103) and bottom electrode (105) of that switch is connected. The signal from the satellite dish connected to that switch will then be sent to the low noise amplifier (LNA) through the corresponding bottom electrode. Information from all the other satellite dishes will not get through, since all other switches in the array are open.

2. L-shape Switch Arrays

Another preferred embodiment of the switch array for microstrip transmission lines is shown in FIG. 8(*b*), where a zigzag step (110) is etched on a dielectric substrate to divide it into two regions: the top front surface (111) and the bottom front surface (112). Parallel bottom electrodes (113) are deposited in the left region (112) and all bottom electrodes are joined together by a line of metal (114) at one end of the electrodes. The top electrode cantilevers (115) are deposited so as to be 90 degrees apart from the counter electrodes (113). A layer of magnetic film (not shown) is deposited on the top electrodes. The thin film coils (116) are deposited on top of the insulating layer (not shown) with the center contacts connected to the ground plate underneath (not shown).

3. Switch Array With the Electrodes on the Same Level

In FIG. 8(*c*), the schematic top-view of a switch array with all the electrodes built on the same level is shown. On a dielectric substrate (120), two sets of parallel electrodes (121) and (122) of different lengths are deposited and there is a gap (123) for each pair of electrodes. On the side of each pair of electrodes, a dielectric block (124) is deposited on the substrate (120) near the gap and a dielectric cantilever (125) with a magnetic coat on top and a metal layer on the bottom (both not shown) is built on each dielectric block (124). Thin film electromagnetic coils (126) are deposited on top of the insulating layer and the ground metal (both not shown) built on the back of the substrate (120).

The simplified schematic layout of the control system for this switch array is shown in FIG. 8(*d*), where the thin film electromagnetic coils (126) are arranged in the same fashion with the electrodes on the front of the substrate. The central contact (127) of each coil (126) is connected to the ground layer (128) built onto the back surface of the substrate. The other contact (129) of the coils is connected to the external control circuits.

Preferred Embodiment of Enhanced Switch

Figure 9:
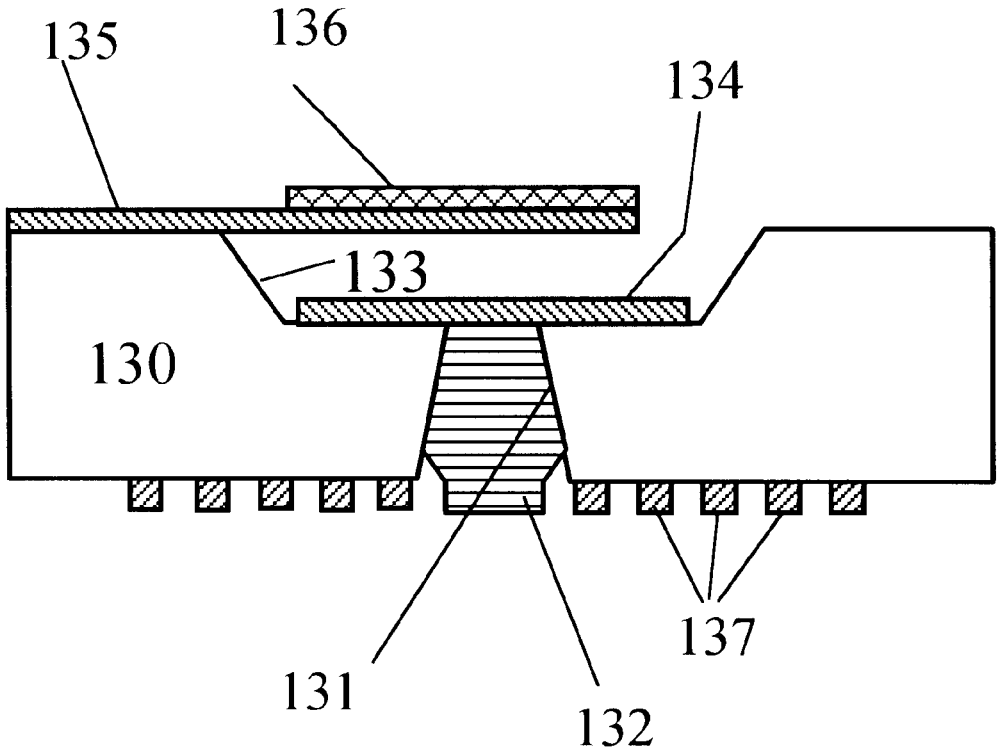
FIG. 9 is a schematic side view of an enhanced miniature electromagnetic microwave switch with a ferroalloy core added.

The miniature switches described above can be enhanced by adding a ferroalloy core as shown in FIG. 9. The addition of a ferroalloy core will increase the induced magnetic field and therefore reduced the minimum control current needed to pull down the cantilever or the pull down threshold current. In order to accommodate a ferroalloy core in a dielectric substrate (130), a cavity (131) is etched into the back of the substrate (130). A ferroalloy core (132) is then deposited or inserted into the cavity (131). It should be noted that other structure of the ferroalloy core can also be used in such a way that the magnetic flux can be concentrated near the cantilever region to facilitate the actuation. A channel (133) is also etched in the front of the substrate (130) to accommodate the bottom electrode (134). The top electrode (135) with the magnetic film (136) on top forms the cantilever of the switch.

Preferred Embodiment of Miniature Switches With a Self-Supported Cantilever

Figure 10:
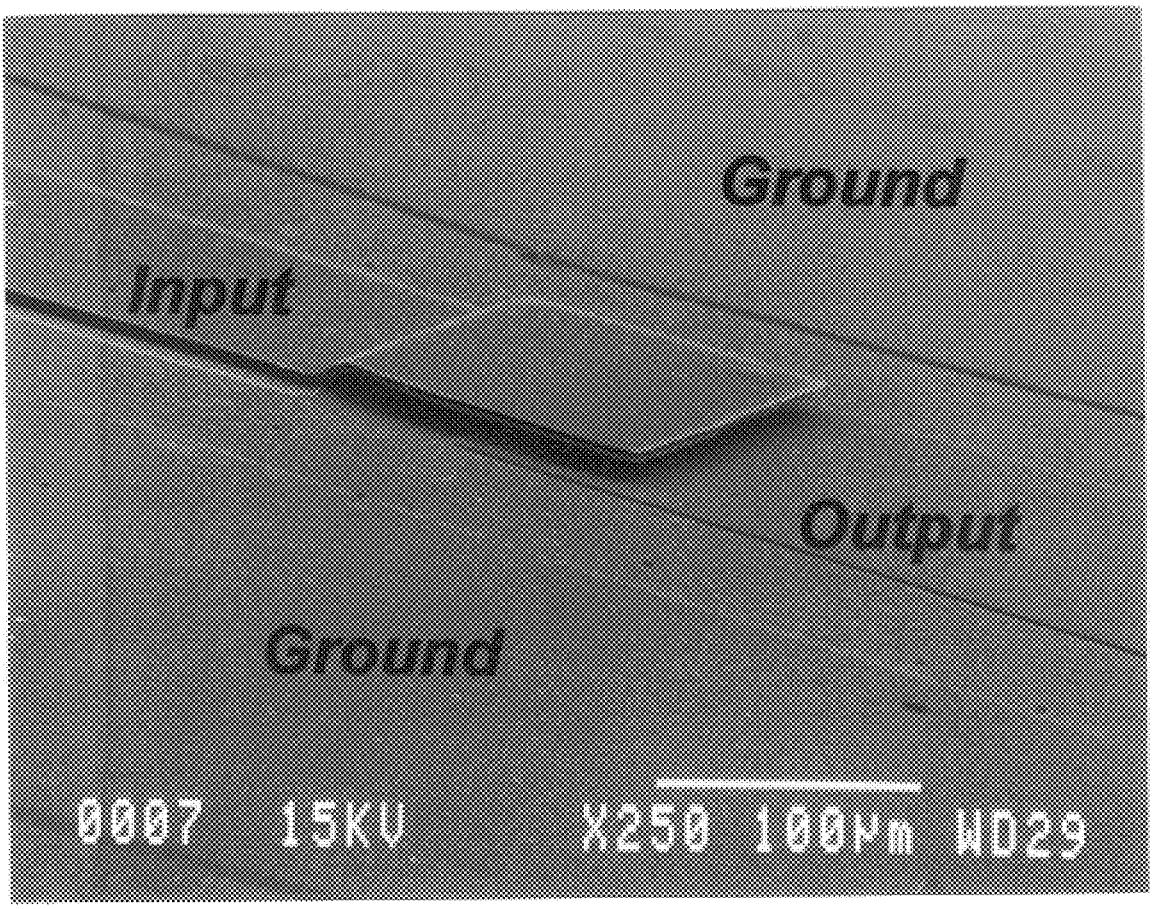
FIG. 10 is a SEM picture showing a cantilever supported by a metal hinge sits on a dielectric substrate.

The cantilever of the miniature switches can be fabricated using a different method. In this method, a sacrificial material is applied to cover a dielectric substrate. It is then patterned so that the sacrificial material, with a small dome-shaped pattern attached at one side, covers only part of the substrate. The diameter of the dome is smaller than the width of the electrodes. After the evaporation and patterning, a metal strip is formed partly on the dielectric substrate and partly on the sacrificial layer with the bubble dome in the middle. Removing of the sacrificial material leaves a cantilever supported by a metal bubble attached to it. To one side of this metal bubble, is the cantilever and to the other side is the metal strip as one of the electrodes of the switch. The cantilever can also be made simply by form a sloped edge on the sacrificial layer and evaporate a metal strip over the sloped edge. An elevated cantilever supported by a hinge is formed after the removing of the sacrificial layer. Such a hinge and a cantilever are shown in FIG. 10. This method enable one to fabricated a miniature switch without first making a step on the dielectric substrate.

The foregoing description is illustrative of the principles of the present invention. The preferred embodiments may be varied in many ways while maintaining at least one basic feature of the miniature electromagnetic switches: A cantilever being actuated by a magnetic coil. Therefore, all modifications and extensions are considered to be within the scope and spirit of the present invention.

The embodiments of the invention in which an exclusive property or privilege is claimed are defined as follows:

1. A miniature electromagnetic microwave switch for coplanar waveguide transmission lines comprising;

(a) a first dielectric substrate having at least one input conducting electrode and at least one output conducting electrode deposited on front surface of said first dielectric substrate for propagation of microwave signals;

(b) a cantilever with projection overlapping at least a part of said input conducting electrode and output conducting electrode;

(c) a magnetic film deposited on a part of a front surface of said cantilever opposing said first dielectric substrate for actuating said cantilever and causing said microwave signals to propagate from said input conducting electrode to said output conducting electrode;

(d) at least two conducting ground strips, one on each side of said input and output conducting electrodes to effect propagating of said microwave signals;

(e) a first thin film electromagnetic coil on a back surface of said first dielectric substrate for actuating said cantilever, the center of said first thin film electromagnetic coil substantially coinciding with the center of said magnetic film.

2. A miniature electromagnetic microwave switch as defined in claim 1, further comprising means to supply an electric current to said first thin film electromagnetic coil, said electric current being greater than a pull down threshold current, to actuate said cantilever, causing electric connection between said input conducting electrode and output conducting electrode.

3. A miniature electromagnetic microwave switch as defined in claim 1, wherein said cantilever is selected from a group of a metal membrane, a dielectric membrane with a conducting coating on a front surface and a dielectric membrane with a conducting coating on a back surface.

4. A miniature electromagnetic microwave switch as defined in claim 1, wherein said input conducting electrodes and output conducting electrodes are patterned conducting thin films with thicknesses between 0.5 $\mu$m and 10 $\mu$m.

5. A miniature electromagnetic microwave switch as defined in claim 1, further comprising a dielectric layer deposited between said cantilever and magnetic film to improve propagation of microwaves.

6. A miniature electromagnetic microwave switch as defined in claim 1, further comprising a means for connecting said cantilever electrically to said input conducting electrodes.

7. A miniature electromagnetic microwave switch as defined in claim 1, wherein said magnetic film is selected from a group of permanent magnetic films and soft magnetic films.

8. A miniature electromagnetic microwave switch as defined in claim 1, wherein an electric current is supplied to said first thin film electromagnetic coil, causing an actuation and an electric connection between said input conducting electrode and output conducting electrode, said cantilever is released by switching off said electric current being supplied to said first thin film electromagnetic coil.

9. A miniature electromagnetic microwave switch as defined in claim 1, wherein an electric current is supplied to said first thin film electromagnetic coil, causing an actuation and an electric connection between said input conducting electrode and output conducting electrode, said cantilever is released by supplying an opposing electric current to said first thin film electromagnetic coil.

10. A miniature electromagnetic microwave switch as defined in claim 1, further comprising an enhancing core inserted into a cavity etched in said first dielectric substrate in a central region of said first thin film electromagnetic coil to decrease pull down threshold current for actuation.

11. A miniature electromagnetic microwave switch as defined in claim 1, further comprising a second dielectric substrate containing a second thin film electromagnetic coil for enhancing the actuating of said cantilever.

12. A miniature electromagnetic microwave switch for microstrip transmission lines comprising;

(a) a first dielectric substrate having at least one input conducting electrode and at least one output conducting electrode deposited on a front surface of said first dielectric substrate for propagation of microwave signals;

(b) a cantilever with projection overlapping at least a part of said input conducting electrode and output conducting electrode;

(c) a magnetic film deposited on a part of a front surface of said cantilever opposing said first dielectric substrate for actuating said cantilever and causing said microwave signals to propagate from said input conducting electrode to output conducting electrode;

(d) a conducting ground layer deposited on a back surface of said first dielectric substrate;

(e) a dielectric film coated on part of said conducting ground layer;

(f) a first thin film electromagnetic coil on said dielectric film for actuating said cantilever, the center of said first thin film electromagnetic coil substantially coinciding with the center of said magnetic film.

13. A miniature electromagnetic microwave switch as defined in claim 12, further comprising means to supply an electric current to said first thin film electromagnetic coil, said electric current being greater than a pull down threshold current, to accurate said cantilever, causing electric connection between said input conducting electrode and output conducting electrode.

14. A miniature electromagnetic microwave switch as defined in claim 12, wherein said cantilever is selected from a group of a metal membrane, a dielectric membrane with a conducting coating on a front surface and a dielectric membrane with a conducting coating on a back surface.

15. A miniature electromagnetic microwave switch as defined in claim 12, wherein said input conducting electrodes and output conducting electrodes are patterned conducting thin films with thicknesses between 0.5 $\mu$m and 10 $\mu$m.

16. A miniature electromagnetic microwave switch as defined in claim 12, further comprising a dielectric layer deposited between said cantilever and magnetic film to improve propagation of microwaves.

17. A miniature electromagnetic microwave switch as defined in claim 12, further comprising a means for connecting said cantilever electrically to said input conducting electrodes.

18. A miniature electromagnetic microwave switch as defined in claim 12, wherein said magnetic film is selected from a group of permanent magnetic films and soft magnetic films.

19. A miniature electromagnetic microwave switch as defined in claim 12, wherein an electric current is supplied to said first thin film electromagnetic coil, causing an actuation and an electric connection between said input conducting electrode and output conducting electrode, said cantilever is released by switching off said electric current being supplied to said first thin film electromagnetic coil.

20. A miniature electromagnetic microwave switch as defined in claim 12, wherein an electric current is supplied to said first thin film electromagnetic coil, causing an actuation and an electric connection between said input conducting electrode and output conducting electrode, said cantilever is released by supplying an opposing electric current to said first thin film electromagnetic coil.

21. A miniature electromagnetic microwave switch as defined in claim 12, further comprising an enhancing core inserted into a cavity etched in said first dielectric substrate in a central region of said first thin film electromagnetic coil to decrease pull down threshold current for actuation.

22. A miniature electromagnetic microwave switch as defined in claim 12, further comprising a second dielectric substrate containing a second thin film electromagnetic coil for enhancing the actuating of said cantilever.

23. A miniature electromagnetic microwave switch as defined in claim 12, further comprising a second dielectric substrate on top of said switch to form a miniature switch for microwave striplines, said second dielectric substrate having a conducting coating on a front surface.

24. A miniature electromagnetic microwave switch as defined in claim 12, further comprising a second thin film electromagnetic coil, said second thin film electromagnetic coil being provided on a front surface of a second dielectric substrate, said front surface is coated with a conducting coating and a dielectric coating.

25. A miniature electromagnetic microwave switch as defined in claim 12, further comprising at least one electrode on a back surface of a second dielectric substrate for forming a two-throw switch for microwave striplines.

26. A miniature two-throw microwave switch as defined in claim 25, wherein said cantilever having a multi-layer structure of metal/dielectric/magnet/dielectric/metal.

* * * * *